United States Patent [19]

Gibson

[11] 4,391,107

[45] Jul. 5, 1983

[54] SPIRAL GYRATOR FOR WASHING MACHINES

[76] Inventor: George M. Gibson, 322 Brookvale Rd., Kinnelon, N.J. 07405

[21] Appl. No.: 265,936

[22] Filed: May 21, 1981

[51] Int. Cl.[3] ..... D06F 17/10

[52] U.S. Cl. ..... 68/133; 68/134

[58] Field of Search ..... 68/133, 134; 366/321-324

[56] References Cited

U.S. PATENT DOCUMENTS

| | | | |
|---|---|---|---|
| 1,810,047 | 6/1931 | Hersh | 68/134 |
| 1,923,580 | 8/1933 | Nelson | 68/134 X |
| 3,464,239 | 9/1969 | Hubbard et al. | 68/134 |
| 4,103,522 | 8/1978 | Gibson | 68/134 X |

*Primary Examiner*—Philip R. Coe

*Attorney, Agent, or Firm*—Glenn H. Antrim

[57] ABSTRACT

A spiral gyrator to be driven unidirectionally at a rate within the normal range for drying by spinning has a spiral strip about a base and upwardly on a central, upright post. The direction of the spiral is reversed for a turn near the top of the post. The first part of the spiral strip farthest from the center on the base has a plurality of spaced slots through it for creating radial jets of washing fluid to move wash rapidly in a pulsating manner. The rotative driving apparatus for the gyrator is simplified, and the reverse turn of the spiral strip near the top of the post prevents wash from being forced over the top of the post while the rotation of the gyrator is reversed and the tub of the washing machine is accelerating to a spinning rate.

2 Claims, 3 Drawing Figures

SPIRAL GYRATOR FOR WASHING MACHINES

BACKGROUND OF THE INVENTION

This invention relates to washing machines having impellers to be rotated unidirectionally, and particularly to washing machines with gyrators having spiral driving surfaces on the bases and the posts thereof to be rotated at speeds commonly used for spinning.

A brief history of the background of development of unidirectional washing machines is given in the background of U.S. Pat. No. 4,103,522 issued to the present inventor on Aug. 1, 1978. The gyrator described in that patent has a low profile with a volute surface that drives the wash outwardly along the bottom of a tub. Because of the gradual outer, spiral surface of the gyrator, it can be rotated unidirectionally with minimal whirling and entangling of wash. Earlier washing machines having gyrators to be rotated unidirectionally did not wash as well as reciprocating impellers, and special precautions had to be taken to prevent whirling and entangling.

SUMMARY OF THE INVENTION

In addition to a spiral driving surface as described above for the gyrator with a low profile, the gyrator of the present invention has through a rib at the base, slots that function as channels for providing outward jets and a continuation of the spiral driving surface up a center post that is to be positioned over a usual drive shaft. The direction of the spiral is reversed near the upper part of the post to prevent materials that are being washed from being driven over the top of the post when the gyrator is operated in a reverse direction. While the gyrator is operated in a normal direction of rotation and wash at its base is being driven outwardly by the spiral surface and the jets, the spiral on the lower portion of the post drives the wash downwardly to the vicinity of the base. Although the use of only the spiral driving surface on the base is effective to drive the wash outwardly with sufficient pulsating action for cleaning, the slots as channels through the lower end of the spiral driving surface slings washing fluid outwardly in jets that intensify outward force on the wash and produce intense pulsating action.

Although the gyrator will likely be rotated in the direction for driving the wash outwardly at the base of the gyrator, it can be rotated in a reverse direction for creating a cyclonic action for adequate cleaning. While the gyrator is operated in the reverse direction to cause an upward flow in the center of the tub, the upper spiral on the post tends to force the wash downwardly and thereby prevents materials that are being washed from being pushed over the top of the post. Even when the gyrator is operated in the direction for causing downward flow in the center of the tub, the reverse upper spiral is required in washing machines in which the direction of rotation of an electric motor is reversed to change from a washing cycle to a spinning cycle. In such machines, the rotation of the gyrator is reversed quickly and then the loaded tub is accelerated at a much slower rate through a clutch. During this period of acceleration, the gyrator is rotated in a reverse direction with respect to the tub, and the upper reverse spiral functions to prevent wash from being pushed over the top of the post. By reversing the spiral, a more costly mechanical means for preventing the relative reverse direction of operation is not required.

DESCRIPTION OF THE PREFERRED EMBODIMENT

Figure 1:
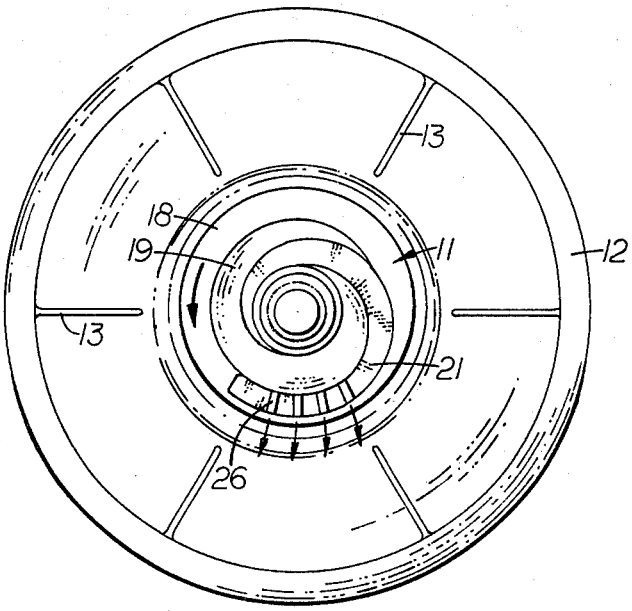
FIG. 1 is a top view of a round tub of a washing machine having centered in its bottom a spiral gyrator of this invention.
Figure 2:
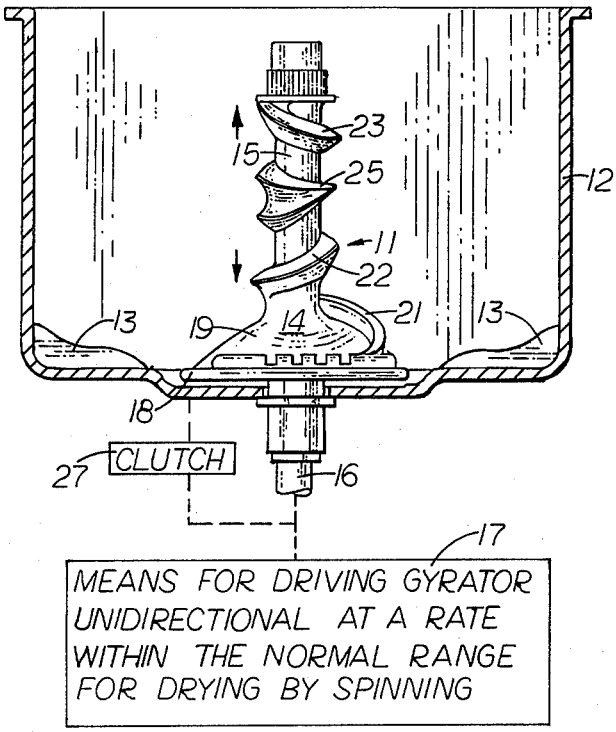
FIG. 2 is a vertical cross-sectional view of the round tub of FIG. 1.

In FIGS. 1 and 2, the gyrator 11 according to the present invention is shown mounted in the center of the bottom of the round tub 12 that is conventional except for low baffles 13 extending radially inwardly. Since the gyrator 11 is constructed to provide nearly radial flow of washing fluid from its base, the use of the baffles 13 is optional because they are generally not required to prevent whirling of wash. The optional baffles 13 need be only about 1-inch (25.4 mm) high and could preferably extend inwardly from the wall of the tub 12 such that their inner ends, which may be tapered downwardly, are spaced a short distance from the periphery of the gyrator 11.

The gyrator 11 comprises a base 14 and a coaxial, upright post 15 connected in a conventional manner to a shaft 16 driven unidirectionally by the means 17. A circular lower portion 18 of the base 14 has a plane lower side adjacent the bottom of the tub 12 and an upper portion 19 generally bell-shaped like the frustum of a cone. The base of the conical portion 19 is centered over the lower portion 18, and the post 15 extends upwardly from the truncated apex of the conical portion 19. The diameter of the lower portion 18 may be about one-half the diameter of the tub 12, and the diameter of the base of the conical portion 19 is somewhat smaller than the diameter of the lower portion 18 to provide the margin 20 of the lower portion 18 about the base of the conical portion 19. The post 15 extends the usual distance upwardly to a level just below the top of the tub 12 and is coupled to the drive shaft 16 in a usual manner.

Figure 3:
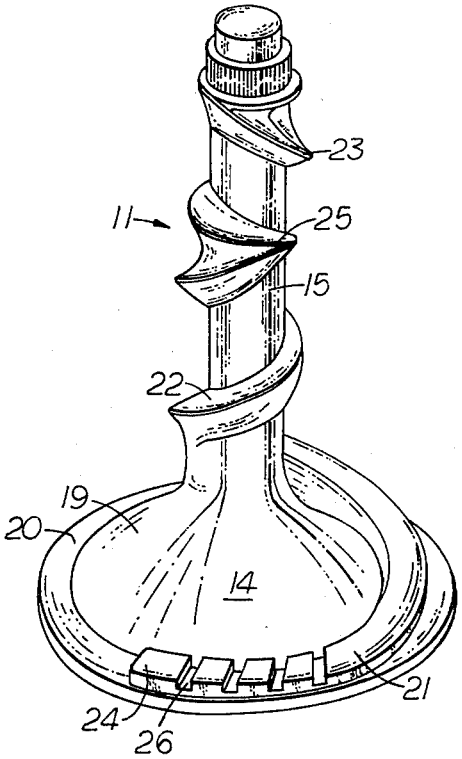
FIG. 3 is a perspective view of the gyrator.

The driving surface of the gyrator 11 as shown most clearly in FIG. 3 comprises a ridge 21 that extends from the margin 20 of the lower portion 18 spirally about the conical portion 19 and continues through lower turns 22 about the post 15 to the upper portion where the spiral reverses in direction to provide a reverse turn 23 near the upper end of the post. The portion of the ridge 21 on the margin 20 is generally rectangular in cross section and is substantially wider than it is thick, and the spiral portion 22 on the lower part of the post continues in the same direction and is beveled like an expanded screw thread. Somewhat above the center of the post 15, the spiral raised strip 22 reverses in direction somewhat gradually and smoothly at point 25 to provide near the upper end of the post 15 a reverse spiral turn 23. The contours of the ends and the edges of the spiral strip 21 are smooth and gradual to prevent damage to materials being washed.

The lower end 24 of the strip 21 has a plurality of spaced, transverse slots 26 along a portion of a turn along the upper surface of the margin 20 of the base 14. The dimensions of the slots 26 are not critical; for example, the width of the slots might be between 3/16 inch (4.8 mm) and ½ inch (12.7 mm).

The gyrator 11 washes economically and efficiently when rotated unidirectionally in either direction at a rate within the normal range for drying by spinning.

When the lower end 24 and the lower portion 22 of the raised strip 21 spiral in the direction shown and the gyrator 11 is rotated counterclockwise as viewed from above, the spiral portion 22 moves clothes of a wash downwardly and outwardly over the conical portion 19, and the expanding motion of the lower portion 24 of the spiral raised strip 21 forces the wash radially outwardly. The slots 26 throw water radially outwardly as jets in directions shown by the arrows in FIG. 1 to maintain the wash in nearly a radial direction from the lower portion of the gyrator 11 along the bottom toward the wall of the tub 12. Compared with using only a spiral surface for agitating the wash, the slots increase the intensity of the outward thrust and intensify a pulsating action to unfurl and clean the wash. Compared with usual washers, particularly with unidirectional washers, the materials being washed are kept well unfurled so that entanglement is almost wholly eliminated. After the wash is forced outwardly along the bottom of the tub 12, the clothes circulate upwardly and inwardly and down along the post 15 where the spiral portion 22 on the post helps urge the wash downwardly along the base 14 of the gyrator 11.

The most economical way to change from a washing mode to a spinning mode is to reverse the direction of operation of a motor of the driving means 17 by electrical control. Upon reversing the motor, a clutch 27 as shown schematically in FIG. 2 is engaged and slips while the tub 12 is being accelerated. During this period of acceleration, the direction of rotation of the gyrator 11 with respect to the tub 12 is in a direction opposite to that during the washing cycle. Had the lower portion 22 of the spiral on the post 15 been continued in the same direction to the top of the post, materials being washed would be driven upwardly and likely over the top of the post 15. To prevent this action that might be harmful, the upper portion 23 of the spiral is reversed to drive the wash away from the top of the post.

A gyrator 11 with the spiral surfaces in the directions shown will also function effectively when rotated in a clockwise direction as viewed from above. When rotated in a clockwise direction, wash is drawn toward the post 15 at the bottom of the tub 12 and circulated upwardly in a cyclonic manner. Regardless of the direction of operation of the gyrator 11, the gyrator is operated at the same rate as that of the tub for spinning to simplify the driving means 17 for both washing and spinning.

I claim:

1. A washing machine comprising:

a tub having a bottom and a substantially vertical wall for enclosing a space to contain wash, a gyrator having a base and a driving post, said base subtending a substantial portion of said bottom, said base having an outer circumferential portion and an inner upper portion shaped substantially as a frustum of a cone, the base of the cone being parallel with said bottom and said outer portion extending outwardly therefrom, said driving post extending coaxially upwardly from the truncated end of said inner portion of said base, a driving surface comprising a spiral ridge having one end positioned substantially circumferentially on the upper surface of said outer circumferential portion and extending from said one end gradually inwardly and upwardly in one circumferential direction on the surface of said inner portion of said base to said truncated end thereof and continuing in said one circumferential direction like an expanded helical screw thread upwardly about said driving post to an upper intermediate region of said post where said ridge gradually reverses in circumferential direction to form at least one helical turn of opposite direction near the upper end of said driving post, the ends of said driving surface having gradual and smooth contours, and unidirectional driving means connected to said driving post to rotate said gyrator about said axis thereof.

2. A washing machine as claimed in claim 1 wherein said ridge on said upper surface of said peripherial portion of said base has a plurality of spaced slots as channels thereacross to provide radial jets of washing fluid as said gyrator is rotated unidirectionally.

* * * * *